US005513843A

United States Patent [19]

Russell

[11] Patent Number: 5,513,843

[45] Date of Patent: May 7, 1996

[54] CONVERTIBLE PRACTICE SYSTEM FOR FIELD GOAL KICKING

[76] Inventor: Frank A. Russell, 2784 W. 1600 North, Clinton, Utah 84015

[21] Appl. No.: 45,635

[22] Filed: Apr. 9, 1993

[51] Int. Cl.[6] ..... A63B 67/00

[52] U.S. Cl. ..... 273/55 B; 273/127 B

[58] Field of Search ..... 273/55 D, 26 A, 273/26 A, 127 B, 165, 410

[56] References Cited

U.S. PATENT DOCUMENTS

| | | | |
|---|---|---|---|
| D. 212,767 | 11/1968 | Frischman et al. . | |
| D. 250,283 | 11/1978 | Norton . | |
| D. 321,736 | 11/1991 | Franklin et al. . | |
| 648,512 | 5/1900 | Manley | 273/55 D |
| 2,525,304 | 10/1950 | Lindsay . | |
| 2,899,204 | 8/1959 | Ratay . | |
| 3,427,026 | 2/1969 | Mahoney | 273/26 A |
| 3,675,922 | 7/1972 | Nieland | 273/55 D |
| 3,762,706 | 10/1973 | Cavett . | |
| 3,820,787 | 6/1974 | Heinbigner | 273/55 D |
| 3,831,940 | 8/1974 | Molettieri . | |
| 3,897,948 | 8/1975 | Gerala . | |
| 3,908,992 | 9/1975 | Cunningham | 273/55 D |
| 4,049,267 | 9/1977 | Forrest . | |
| 4,564,237 | 1/1986 | Steifensand . | |
| 4,632,395 | 12/1986 | Ferrebee . | |
| 4,648,596 | 3/1987 | Long . | |
| 4,786,053 | 11/1988 | Barnes | 273/55 D |
| 4,826,166 | 5/1989 | Baker et al. . | |
| 4,905,996 | 3/1990 | Tallent et al. | 273/26 A |
| 5,193,802 | 3/1993 | Saltus | 273/26 A |
| 5,249,796 | 10/1993 | Silvi | 273/55 D |

*Primary Examiner*—Theatrice Brown

[57] ABSTRACT

A system is disclosed comprising a goal and kicking pad for practicing kicking for football and soccer. The goal portion provides a yoke through which a football is kicked, the yoke being selectively elevated on a post connected to a base. The goal is configurable as a soccer goal by turning the yoke downward and angling the post as a diagonal support between the base and the yoke. For field goal kicking, the kicking pad securely holds a football in a desired position above a surface, and is quickly adjustable to any desired position without tools. The kicking pad operates equally well for kicking with a right foot or a left foot.

16 Claims, 5 Drawing Sheets

CONVERTIBLE PRACTICE SYSTEM FOR FIELD GOAL KICKING

BACKGROUND OF THE INVENTION

1. Field of the Invention

This invention relates to athletic practice equipment generally, and specifically to a system and apparatus for field goal kicking for football and soccer.

2. Description of the Prior Art

As the game of football in America has developed over the past several decades, special skills have become more important. Special teams or players are drafted into professional clubs or trained in amateur school teams to accomplish tasks of particular use. Passing, running, punting, kicking off, and field goal kicking have their own unique required skills.

Among those skills is the ability to accurately kick a field goal at a long distance. A field goal requires that a kicker loft the football down the field where it passes over a horizontal bar between upright arms which together constitute the goal or goal post. Field goals at a distance greater that half the length of the field are attempted, often in the closing minutes of a close game. Field goals of 10 to 30 yards are more common as a means of accumulating points when a touchdown is uncertain. By contrast, a punt just requires maximum distance down-field within the field width, a kickoff likewise. Thus, a field goal requires a combination of great accuracy and distance.

Kicking is sufficiently important that kickers are often trained to do that one function and no other on the team. The football is positioned on a pad under its lower end. The pad holds the ball up away from the ground, allowing the kicker's foot to get underneath to lift the ball higher. Another player holds the opposite end of the ball with a finger. The top of the ball is tilted back, placing the axis of the ball at a desired angle from vertical toward the kicker.

By contrast, a punt is kicked from the hand of the kicker, while a kickoff is usually done from a low tee with no player holding the ball. The low tee usually results in the ball having a flight path in a long low arc, often ending with the ball bouncing and tumbling along the ground for a long distance. During a game, professional and college teams have a player hold the upper end of the football for a field goal attempt. High School teams may use a pad or tee. In some High School leagues and most leagues for other young amateurs, rules allow a kicking pad of a type requiring no player to hold the upper end of the ball.

Practice requires much individual effort by each player to hone individual skills. Practice games are an important but lesser part of practice. Thus a kicker practices intensively, but the person holding the ball does not need that time. A player's time is wasted if it is only spent in holding the ball for a kicker. A kicker's time is wasted if it is not spent in nearly game-like conditions.

Particularly important is an ability to kick a ball repeatedly from a known, repeatable position. Thus a kicker can better refine his or her skill to achieve that same predictability in kicking if the position of the ball is exactly predictable.

Kicking pads exist in the art in a plethora of designs. Each needs a means to hold the upper end of the ball as in U.S. Pat. No. 4,632,395 (Ferrebee), U.S. Pat. No. 3,897,948 (Gerela) and U.S. Pat. No. 3,831,940 (Molettieri). Some lift the lower end up off the field as shown in U.S. Pat. Nos. 4,634,122, 4,049,267 (Forrest), and U.S. Pat. No. 3,762,706 (Cavett). Some pads appear to be heavily weighted, and others do not provide for adjustability of the angle of the ball as shown in U.S. Pat. No. 3,762,706 (Cavett). Moreover, adjustability for the height of the ball is ignored in many pads. Besides the standard ball size used in professional leagues, numerous sizes are available in backyards. Simple adjustment to ball length is needed for widespread use of a kicking pad.

Likewise, the member holding the top of the ball is often rigid. Some are arguably sturdy enough to be injurious if improperly approached or if tripped over. E.g U.S. Pat. Nos. 4,946,165, 4,648,596 (Long), U.S. Pat. No. 4,632,395 (Ferrebee) and U.S. Pat. No. 3,762,706 (Cavett).

Other pads use hose-like flexible extensions to hold the ball and prevent injury to a kicker as in U.S. Pat. Nos. 4,634,122, 4,049,267 (Forrest), U.S. Pat. No. 3,831,940 (Molettieri) and U.S. Pat. No. 3,897,948 (Gerela). These configurations are not firm and inherently cannot tolerate or hold a ball at an appreciable angle of tilt.

Thus, the holding member above a football should instead be capable of firmly holding the ball, but light and flexible enough to cause no risk of injury. Since the ball should tilt at its upper end toward a kicker, the upper end of a holding member should firmly resist any undesired movement toward the kicker. At the same time, a kicker should be able to adjust the holding member to a desired angle. Then, after a kick, the holding member should move conveniently out of the way.

Although most players kick exclusively with either the right foot only or the left foot only. The side of the pad on which the holding member operates is therefore obviously important. That side will differ between players, who may have to share a kicking pad.

Another weakness of kicking pads is that their upper surfaces upon which a ball rests are often patterned in a design which is little better than a smooth surface. An ability to grip the lower end of a football firmly but releasably is critical to holding a tilted ball.

In like fashion, the underside of a kicking pad needs to accommodate turf, whether natural or artificial, as well as any other likely practice surface. The pad must be stable and level, but must penetrate through the blades of grass or other turf to stay securely in place. A sharp point will penetrate and a large surface, or points broadly separated, will keep the pad stable and level.

For the youngster learning the game of football, the cost, complexity and risk intrinsic to a kicking pad are not to be ignored. A simple manufacturing, shipping, assembly and storage sequence is needed. From initial manufacture to packaging and shipping, the required space, weight and labor are at a premium. Also, easy assembly and disassembly without tools are needed for daily use, daily or seasonal storage by a user, and for repair incident to abuse and extended use.

The current state of the art has not addressed these needs except in isolation. That is, to the extent one need may be satisfied, another is left the worse due to design trade-offs inherent in all engineering. Several of the needs have not been addressed at all. Backyard practice is a substantial fraction of all football played. The need is perhaps greater there for a cost effective solution to kicking practice. In the instant invention, all the foregoing factors are addressed together in a coherent solution calculated to meet each need.

Goals in general are configured for their individual games. For example a large permanent goalpost in an "H"

shape is permanently installed for football. A smaller, overhead netted enclosure is the goal for soccer. A smaller, approximately waist-high netted enclosure serves as a goal and net for hockey and lacrosse. Football and soccer goals are large enough that installation in a backyard playing field is prohibitively inconvenient, costly or both.

Nevertheless, some sports have goals or apparatus which lend themselves to home practice. Being of reasonable size, basketball goals are ubiquitous. Similarly, systems exist to pitch back a thrown baseball, return tethered tennis balls for practicing service and kick a golf ball back out of the cup after a putt, successful or unsuccessful. Such systems are available in professional, collegiate, high school, and amateur systems. Thus the backyard athlete is adequately served.

Various patents relating to goals for football, hockey and soccer exist. For example, U.S. Pat. No. 3,820,787 (Heinbigner) issued Jun. 28, 1974 discloses a flexible bag attached to a vertical rim on legs to provide a football practice target. Similarly, U.S. Pat. No. 4,826,166 (Baker et al.) issued May 2, 1989 discloses a ground-supported system for targeting and capturing a football. U.S. Pat. No. Des. 250,283 (Norton) issued Nov. 14, 1978 discloses a goal post structure similar to the conventional "H" shaped traditional goal posts for football. U.S. Pat. No. Des. 821,736 (Franklin et al.) issued Nov. 19, 1991 discloses a tabletop football goal and net. U.S. Pat. No. 2,525,304 (Lindsay) issued Oct. 10, 1950 discloses a hockey goal which is capable of absorbing impact.

However, football for children or for backyard practice lacks a reasonable facsimile of a goal. Soccer is likewise without a goal. Notwithstanding a goal of full size may be unwieldy, inconvenient and costly, any task requiring the aiming skill of kicking a football or soccer ball can be done with a smaller goal at a shorter range. That is, any skill akin to marksmanship with a ball can be practiced at close range by narrowing the permissible "window" which constitutes the goal.

For field goal kicking, the football goal must have an appropriate height for its crossbar, with a length thereof to support uprights at a proportionate width. Thus, a kicker needs to practice achieving proper loft of the ball while placing the football between lateral limits. From the point of contact with a player's foot, the ball has a ballistic trajectory. Achieving that trajectory can be practiced at a close range with a smaller goal if the height and width thereof both correspond to the same trajectory as that of a larger goal. Meanwhile, a goal of reduced size may be sufficient in itself for developing skills at a smaller scale commensurate with a young child's skill and size.

For soccer, the goal must have a limited height and width close to the ground. Thus a ball kicked over or wide of the goal "window" should not be counted. Again the smaller target or window area is perhaps more challenging but can be practiced at shorter range for accuracy. For long range equivalent to a game, a small soccer goal, unlike a football goal of reduced size is still beneficial for honing skills associated with both accuracy and distance in all dimensions. By contrast, reduced height at a long distance does not present the same test of the skill of lofting the football. Nevertheless, at close range a reduced height can still be an appropriate challenge to the skill of lofting a football.

SUMMARY OF THE INVENTION

The instant invention is a system for practicing field goal kicking. The system comprises a goal and a pad. The goal is adaptable for use as a soccer goal. The pad accommodates a person using the right foot or one using the left foot with equal ease, adjusting within seconds without tools.

The goal is comprised of a rectangular, "U"-shaped base, post means rotatably connected at one end to the center of the "U," and a "U"-shaped yoke means rotatably secured at its bottom center to the other end of the post means. The yoke means comprises a bar means and a pair of matched uprights extending selectively upwardly in a football configuration and downwardly in a soccer configuration. The post means extends upwardly from the base to the bar means of upwardly-opening the yoke means in the football configuration. The post means extends preferably at approximately a forty-five degree angle from the base to the bar means of the downwardly-opening yoke means in the soccer configuration. A net is provided for selective attachment to the goal in the soccer configuration. The net is preferably configured to attach to the uprights in a football configuration, thus acting as a backstop for the kicked football.

The base is comprised of left and right lateral members collinearly assembled by insertion into respective sides of a first "T" fitting. These form the "bottom" of a "U." The left and right lateral members are fitted with a first and second elbow at the respective distal ends thereof. Into the first and second elbows, left and right extension members fit to form the legs of the "U"-shaped base. The side members are shorter than the extension members. The left and right extension means of the base are fitted with left and right sockets respectively.

The post means is fitted into the leg of the first "T" fitting located at the bottom of the "U" formed by the base. The post means may be a single tubular piece, but is preferably a two-piece telescoping structure. The post means is comprised of an inner and an outer member.

Lock means attached to the post is releasable to allow a first end of the inner member to telescope into one end of the outer member. The outer member fits snugly at its other end into the leg of the first "T" fitting in the base. When the lock means is set, the length of the post means is fixed until the lock means is released. The lock means is preferably frictional so that it can allow slippage in response to a substantial force, such as a player falling against the goal.

The inner member of the post means is snugly fitted at a second end into the leg of a second "T" fitting. Application of sufficient force, to overcome the friction acting thereon, will rotate the first and second "T" fittings. Nevertheless, all fittings maintain their positions under the load of the weight of the goal.

The yoke means is comprised of the left and right side members snugly fitted at their respective proximal ends into the left and right sides of the second "T" fitting. Together the second "T" fitting and left and right side members form the bar means of the yoke means. Fitted at respective distal ends of the left and right side members are left and right elbows. Into the respective left and right elbows are fitted left and right upright of the yoke means. The left and right uprights form the legs of the "U"-shaped yoke means, opening upwardly in the football configuration to terminate with right and left cap means, respectively.

The yoke means can be rotated about the second "T" fitting to open downwardly in a soccer configuration. The left and right extension means of the base are fitted with left and right sockets respectively, comprised of elbows fitted snugly thereto and opening upwardly to receive the left and right uprights. The left and right cap means fit into the left and right sockets to form a conventional soccer goal shape.

The post means can extend to adjust the bar means to a desired height in the football configuration. The post means may likewise be adjusted to assure that the left and right uprights stand vertically in the soccer mode. That is, when the yoke means is vertical in the soccer configuration, the post means must fit between the base resting on the field and the bar means of the yoke means.

The net is preferably made of nylon or other durable fiber tied in an approximately two-inch mesh. The net is in a shape to fit over the back and ends formed by the goal in the soccer configuration. Edges of the net are reinforced with a binding to conform to the goal. The net is selectively attached by elasticized bands connected thereto to fit over the first and second elbows and left and right sockets of the base, and the left and right elbows of the yoke means.

Hooks are also within contemplation as attachment means. Also within contemplation is attachment means therefor on the yoke means. The net may be attached to the yoke means in the football configuration to intercept the football and drop it to the ground as a backstop. Without the net in place, two players can face one another from opposite sides through said yoke. In this way, each can retrieve the ball kicked by the other and place it for kicking in the opposite direction.

All rigid parts and fittings are preferably made with a smooth outer contour rather than either a continuous wall thickness or smooth inner contour such as pipe fittings employ. Each fitting preferably has a continuous outer diameter and continuous curvature in turning any corner. Each fitting is sized to provide approximately twice the engagement length of conventional plastic pipe fittings. All fits are snug, relying on friction to secure parts together and give stability. However, a solid blow to any joint will allow relative rotation of parts and separation, depending on the directions of forces.

In the preferred embodiment, all parts are preferably formed of polyvinylchloride (PVC), polyethylene (PE) or other durable plastics known in the art. However, larger systems are within the contemplation of the inventor and may be constructed using tubing of plastic, composite materials, or metal, with fittings adapted thereto. In such a configuration, size is only limited by the ability of a user to move the system. Wheels positioned at the corners of the base would allow the goal to be rolled about a field. Fittings may be made to lock with quick-release hardware or may be threadedly attachable to support the greater leverage of longer members.

A pad means usable for place-kicking a football is comprised of a base means for supporting a bottom end thereof. The pad means further comprises an arm means rotatably secured at a proximal end to the base means. The arm is preferably comprised of a metal having an annular cross section and sufficient modulus to provide firm holding of the football. On the other hand the arm means is comprised of a material repeatably flexible for adjusting to different sizes of footballs. Steel and aluminum tubing are available and suitable for the arm means, adjusting repeatedly without fracturing or kinking. These materials also allow for a monolithic arm means of uniform cross section extending from the base means to the football. The arm means thus extends arcuately from the base around to the top of the football.

Viewed from the point of view of an approaching user, kicking with the right foot, the arm means is preferably straight near the proximal end thereof, penetrating the pad means to extend slightly therebeyond to the left of the base means. The arm means extends with uniform cross section monolithically out the right side of the base means to a distal end where it contacts a top end of the football for urging the football toward the base means. As the pad means is approached by a user using the right foot, the kicking direction is right footed, indicating that the arm means extends away from, and is positioned to rotate about, the right side of the base means to avoid capturing the right foot. A kicking direction which is left footed indicates that the arm means rotates freely away from the user about the left side of the base means.

The distal end of the arm means is preferably further comprised of tip means for contacting the football at the axial center of the top end thereof. Every football has a recess at the point where its seams meet at each end. The tip means is configured to fit in that recess. The arm means is selectively positionable to orient the longitudinal axis of the football at a desired angle with respect to the base.

The arm means is preferably provided with detent means near the proximal end thereof to engage the base means for resisting rotation of the distal end toward a user. The detent means operates only to resist motion in a single direction. The distal end of the arm means is freely rotatable away from the user in both right footed and left footed kicking directions.

The detent means is further provided with adjustment means for adjusting the position of the arm means with respect to the detent means. The adjustment means is preferably comprised of friction means for selectively holding and releasing the arm means with respect to the base means in response to force by a user.

In one embodiment of the invention, the arm means is secured at its proximal end against separation from the base means by retaining means. The retaining means is preferably comprised of a cap snugly fitted over the proximal end of the arm means to be frictionally engaged thereon and removable without tools by application of axial force.

In a preferred embodiment, the arm means is reversible for kicking with either a right or left foot. A user reverses the direction of operation by lifting the base means from the ground and holding it while rotating the distal end of arm means in the kicking direction. As the arm means rotates around the base means, the distal end of the arm means passing under the base means and back to a position above the base means, the detent means engages to operate in the direction of rotation. Rotation of the base means about a vertical axis to place the arm means on an opposite side of the base means completes reversal of the arm means. After adjustment for the desired angle of the ball the detent means again prevents further rotation of the ball toward a user, yet will rotate freely away from a user.

In a preferred embodiment, the detent means comprises a clamp means frictionally secured by an adjustment means near the proximal end of the arm means near the base means. The adjustment means is preferably a bolt to tighten together ear means formed by opposite ends of the clamp means bolted together.

A protrusion means extends from the base means for engaging the ear means on the clamp means to limit rotation thereof with respect to the base means. The ear means is free to rotate away from the protrusion means. Thus the arm means, may rotate freely with the clamp means away from the protrusion means.

To move toward and past the protrusion means, the arm means must be moved by a user against the force of friction existing between the arm means and the clamp means. That friction is controlled by the adjustment means. The adjustment means is set to resist motion of the arm means in response to the weight of the ball. However, a user can apply additional force to overcome friction, and thus adjust the angle of tilt at which the arm means maintains the ball.

The base means is comprised of an upper surface having gripping means for supporting a football above a surface without sliding thereon. The base means is further comprised of foot means for engaging a supporting surface. In the preferred embodiment, the foot means is comprised of teeth or spikes formed in a lower surface of the base means for penetrating turf and engaging the turf, thus preventing slipping.

DETAILED DESCRIPTION OF THE DRAWINGS

Figure 1:
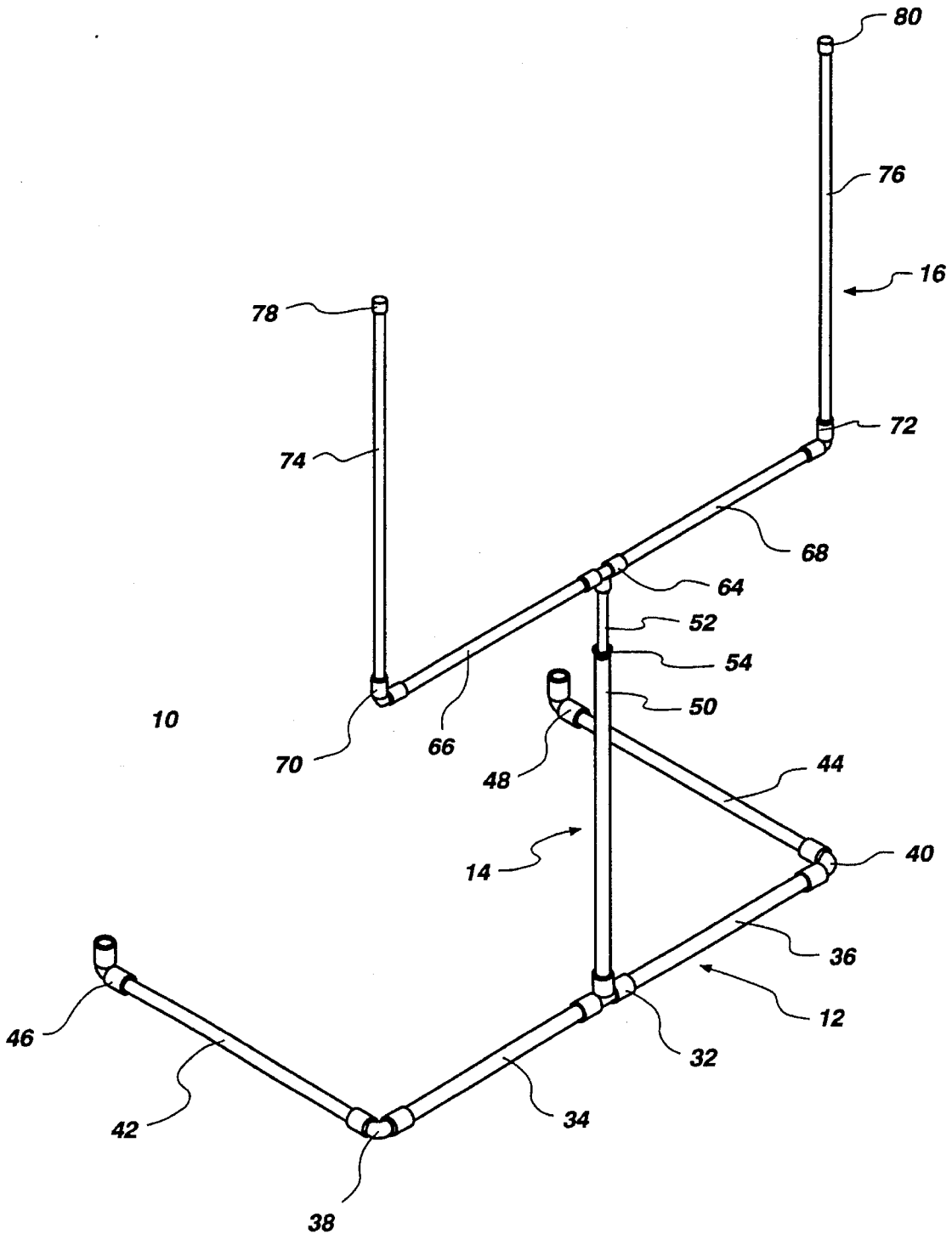
FIG. 1 is a perspective view of the goal in a football configuration.
Figure 2:
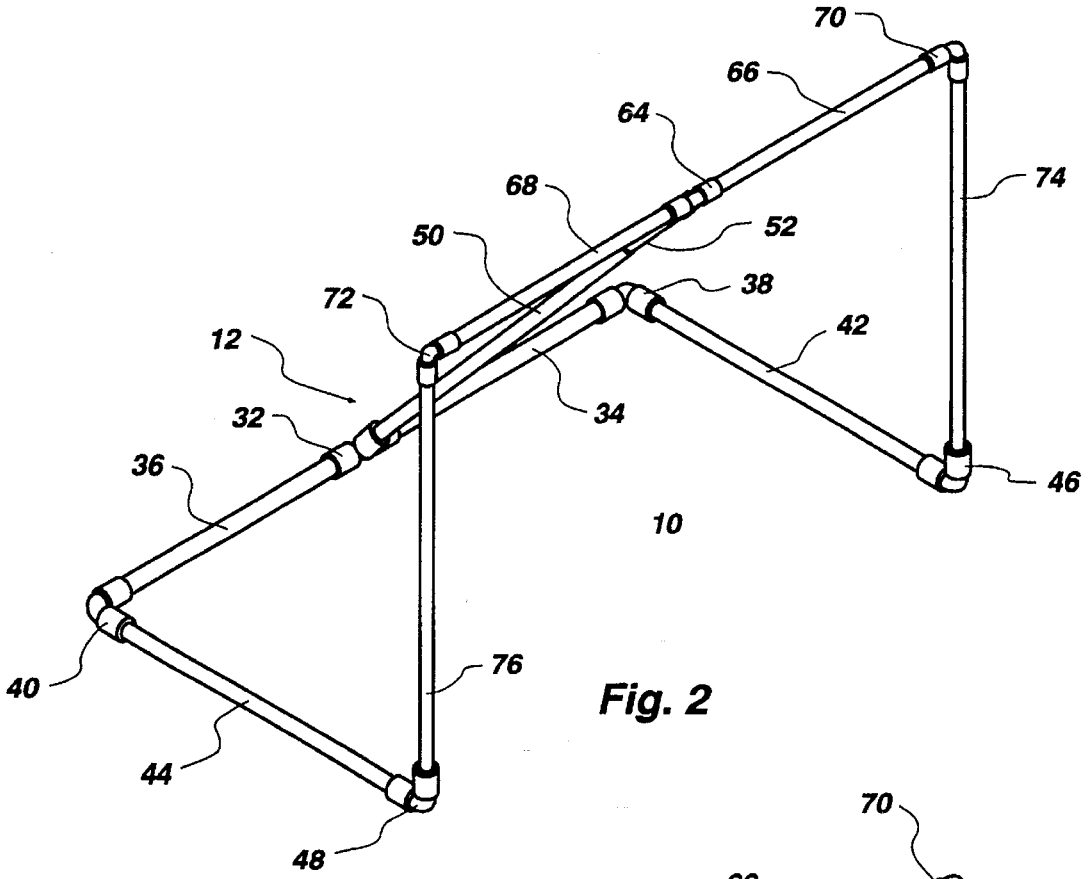
FIG. 2 is a perspective view of the goal of FIG. 1 in a soccer configuration.
Figure 3:
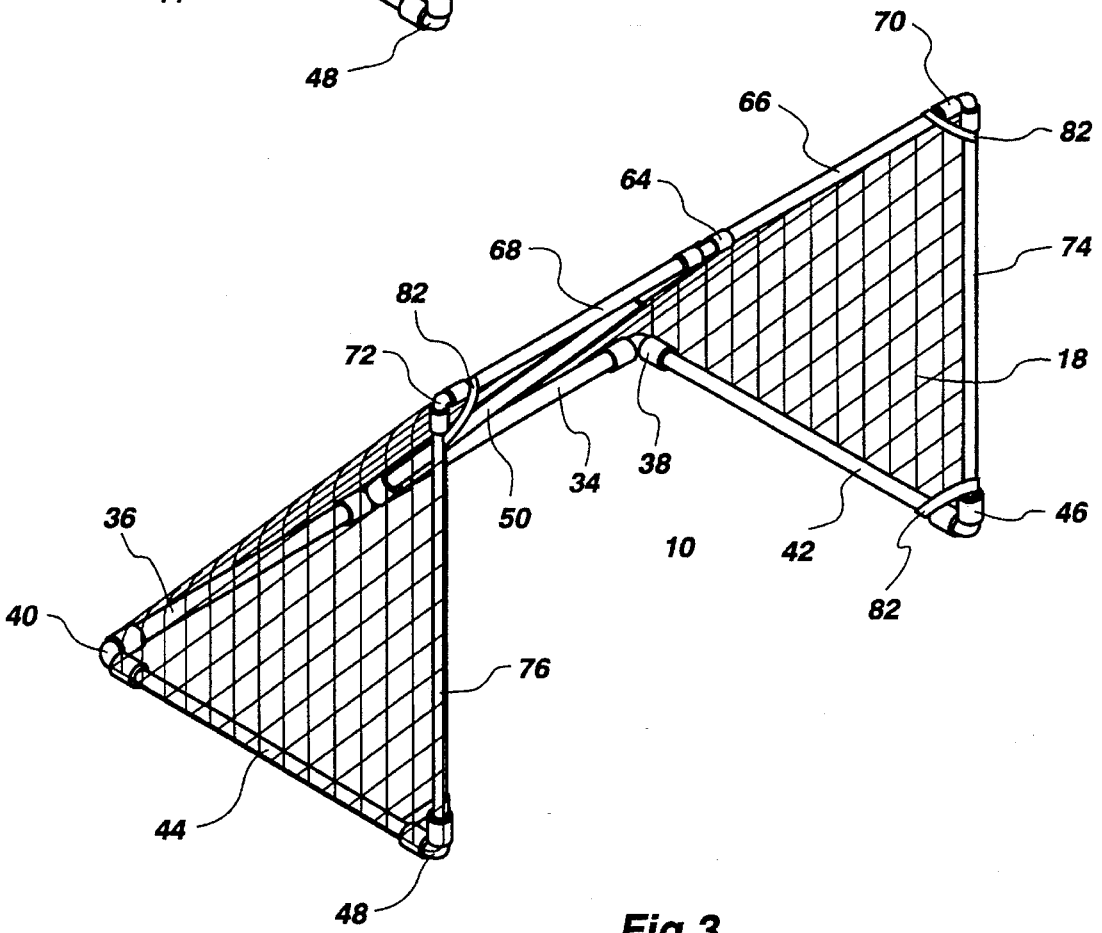
FIG. 3 is a perspective view of the goal of FIGS. 1 and 2 in a soccer configuration with a net attached.

The structure of the apparatus comprising a convertible goal system is understood by reference to FIG. 1 which shows a goal 10 comprised of a base 12 for supporting the goal on a surface, a post 14 for extending above the base 12 a selected distance, and a yoke 16 extending from post 14 to define the goal. FIG. 2 illustrates goal 10 with yoke 16 rotated to extend between post 14 and base 12. FIG. 3 shows the goal 10 with a net 18 to stop a ball kicked through the yoke 16 of the goal 10 by a user.

Figure 5A:
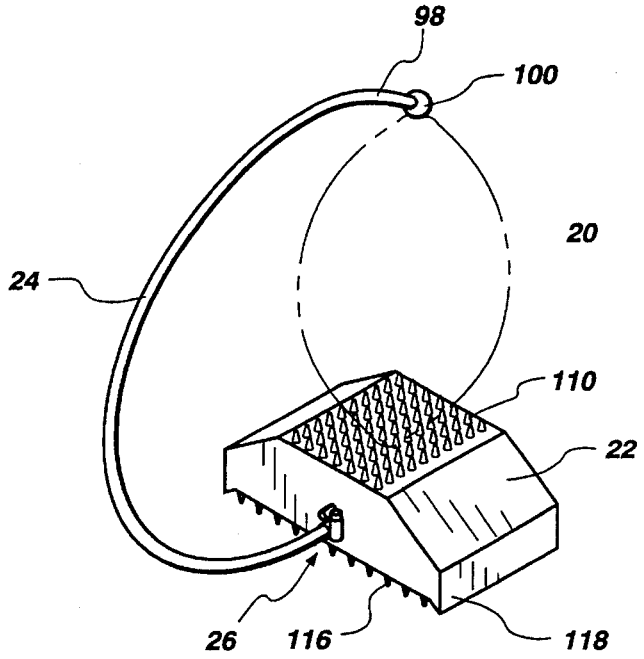
FIG. 5A is a perspective view of the kicking pad.
Figure 5B:
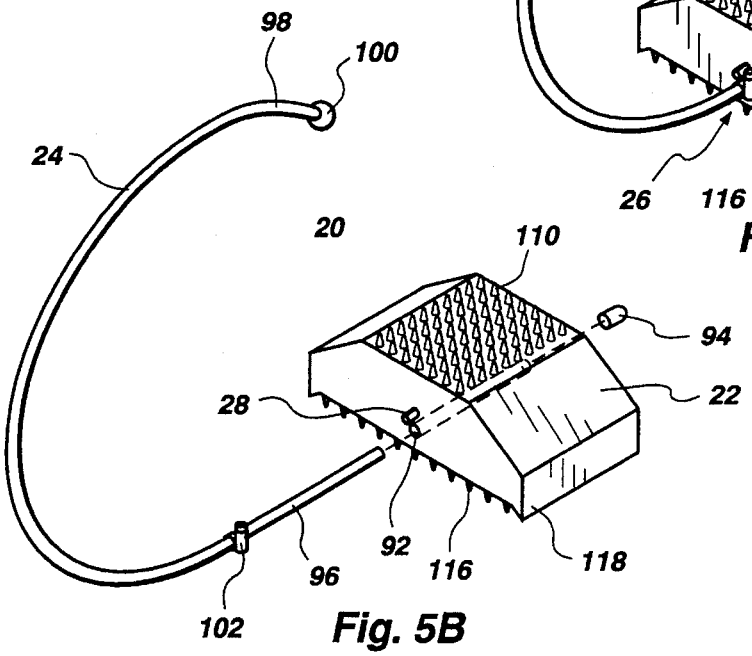
FIG. 5B is a perspective exploded view of the kicking pad.

FIGS. 5A and 5B show the kicking pad 20 used with the goal 10 to form a field goal kicking system. The kicking pad 20 is comprised of a base 22 for supporting a football by its lower end above a surface, an arm 24 pivotally attached to the base for holding the upper end of the football at an angle selected by a user, and an adjustment 26 attached to the arm 24 to selectively and frictionally resist rotation thereof by engaging a detent 28 fixed to the base 22. FIGS. 6A–8B show additional details of the kicking pad 20.

The arm 24 is preferably comprised of aluminum tubing having properties of strength, stiffness and fracture toughness to be bent repeatedly to adjust to different sizes of footballs. The properties of the arm provide and maintain elasticity and stiffness to hold any football by spring-like action, once adjusted to that football. Other materials can also be used such as wire-cored plastics, metals, composite materials and so forth, having the required properties. The preferred embodiment relies on a monolithic length of metal tubing of uniform cross section in constructing the arm as economically, simply and conveniently as possible. A simple arcuate length extending from base 22 to the football serves the function of the arm 24.

The base 12 of the goal 10 of FIGS. 1–3 is comprised of a lower tee 32, sometimes called a "T," into which a left lateral 34 and a right lateral 36 are inserted. A left elbow 38 and a right elbow 40 terminate left and right laterals 34, 36, respectively, inserted therein. Into left and right elbows 38, 40 are inserted left and right extensions 42, 44, respectively, extending parallel, more or less away therefrom to terminate in left and right cups 46, 48. Left and right cups 46, 48 are also elbow-shaped but serve to convert the goal 10 from the football configuration of FIG. 1 to the soccer configuration of FIGS. 2 and 3.

Figure 4A:
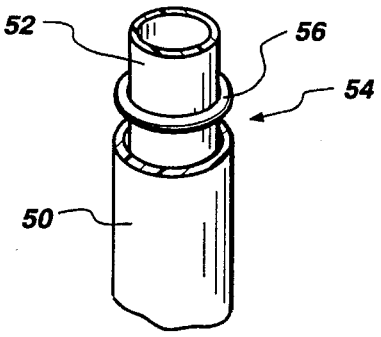
FIG. 4A is a partial perspective view of the post with the preferred embodiment of a locking means in place.

Post 14 is preferably comprised of outer post 50 inserted into lower tee 32 and is fitted with inner post 52 slidably inserted therein. Inner post 52 is provided with lock 54, preferably as shown in FIGS. 1 and 4A, formed of an 'O' ring 56 frictionally fitted to the inner post 52. The 'O' ring 56 can be rolled up and down along inner post 52, but tends to stay where placed by virtue of its frictional fit against inner post 52 and the elastic resistance to stretching which occurs whenever the 'O' ring rolls along inner post 52.

Figure 4B:
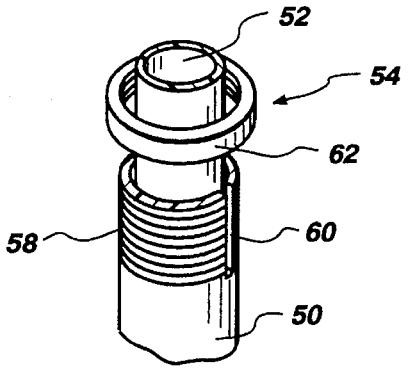
FIG. 4B is a partial perspective view of the post with an alternate embodiment of locking means.

In an alternate embodiment shown in FIG. 4B, a thread 58 and slot 60 are formed in outer post 52. A lock ring 62 is threadedly engaged to outer post 50 by thread 58 creating a compression of outer post 50 around inner post 52 as lock ring 62 is threaded further onto outer post 50. Lock 54 is released by rotating lock ring 62 counter-clockwise off of outer post 50.

Inner post 52 is inserted into upper tee 64 into which left side 66 and right side 68 are inserted to extend away, preferably horizontally. Left side 66 and right side 68 extend into left corner 70 and right corner 72. Left and right corners 70, 72 are elbows, each having two openings at right angles to one another. Thus, left and right extensions 74, 76 are inserted into left and right corners 70, 72, respectively, to extend upwardly, preferably vertically. Left and right caps 78, 80 are snugly fitted over left and right extensions 74, 76, respectively.

Left side 66 can rotate against frictional resistance in upper tee 64 and left corner 70. Similarly, right side 68 can rotate with respect to upper tee 64 and right corner 72. In identical fashion, left and right laterals 34, 36 in base 12 can rotate.

Thus, the entire goal 10 can be collapsed by rotating post 14 down to lie between left and right extensions 42, 44, while left and right uprights 74, 76 are rotated to lie along left and right extensions 42, 44, respectively. The entire goal 10 is thus folded flat for compact storage, without dismantling. On the other hand, all parts can preferably be separated at the joints to dismantle the entire goal 10 for long-term storage.

Referring to FIGS. 2 and 3, post 14 is extended a necessary distance by sliding inner post 52 out of outer post 50, while left and right caps 78, 80 on left and right uprights 74, 76 are turned downward to engage left and right cups 46, 48. Left and right uprights 74, 76 are adjusted to be vertically oriented, creating the soccer configuration seen in FIG. 2.

In FIG. 3, a net 18 is provided with straps 82 secured thereto for fitting over left and right corners 70, 72, left and right cups 46, 48 and left and right elbows 38, 40. The net 18 is thus maintained in position when the goal 10 is in a soccer configuration. By suitable release of selected straps 82, the net can remain on yoke 16 in the football configuration of goal 10 thus acting as a backstop.

Referring to FIGS. 5A and 5B, the kicking pad 20 is comprised of base 22 having aperture 92 into which arm 24 is inserted to rotate. Arm 24 is secured in aperture 92 by removable retainer 94 secured to a proximal end 96 of arm 24. Retainer 94 is preferably a snugly fitted part held by friction so that disassembly is without tools as much as possible. At a distal end 98 of arm 24 is similarly attached a tip 100 for fitting into the end recess of the football, the depression formed by the joining of seams at the ends of the football and characteristic of the end of every football.

Adjustment 26 is comprised of clamp 102, attached to move around arm 24 only when friction therebetween is overcome, and detent 28 fixed to base 22. That is, clamp 102 is frictionally secured to arm 24 to engage detent 28, thus resisting rotation with respect thereto. Arm 24 can be rotated within clamp 102 by application of sufficient force to overcome the friction therebetween. A close look at clamp 102 reveals that arm 24 can be freely rotated as long as clamp 102 moves away from detent 28. Thus adjustment 26 does not restrict movement of distal end 98 of arm 24 when moved in the kicking direction 106 with respect to base 22. Nevertheless, friction forces between clamp 102 and arm 24 hold the upper end of the football, shown in phantom in FIGS. 5A and 5B from tilting in a holding direction 108 beyond a selected position.

Figure 6A:
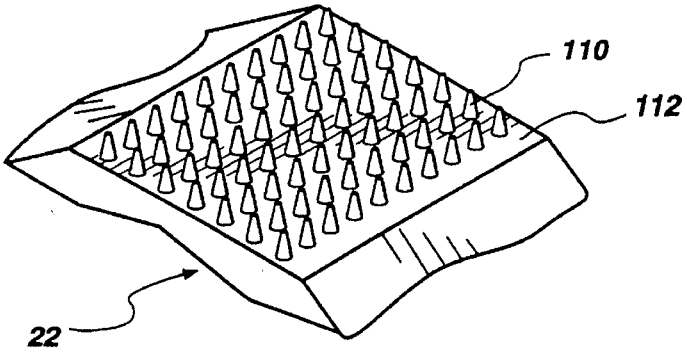
FIG. 6A is a partial perspective view of one embodiment of the upper surface of the base of the kicking pad.
Figure 6B:
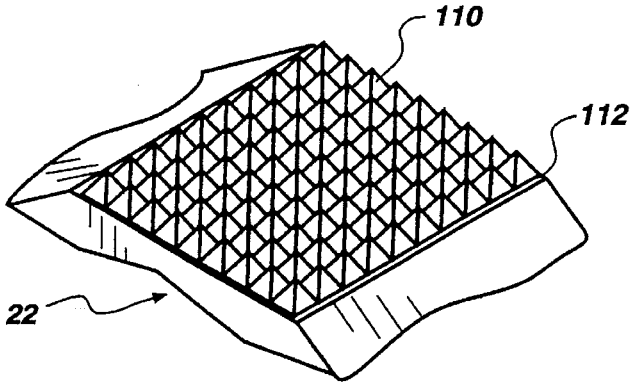
FIG. 6B is a partial perspective view of an alternate embodiment of the upper surface of the base of the kicking pad.

In the preferred embodiment, base 22 is provided with pins 110 which are preferably conical or pyramid shaped as shown in FIGS. 6A and 6B. Pins 110 form a means for engagement of the lower end of the football to prevent sliding between the football and the upper surface 112 of base 22. Various shapes and surface roughness treatments are contemplated within the scope of the invention. Grit and similar treatments act to prevent sliding, as do various other textures besides the preferred embodiments.

Figure 7A:
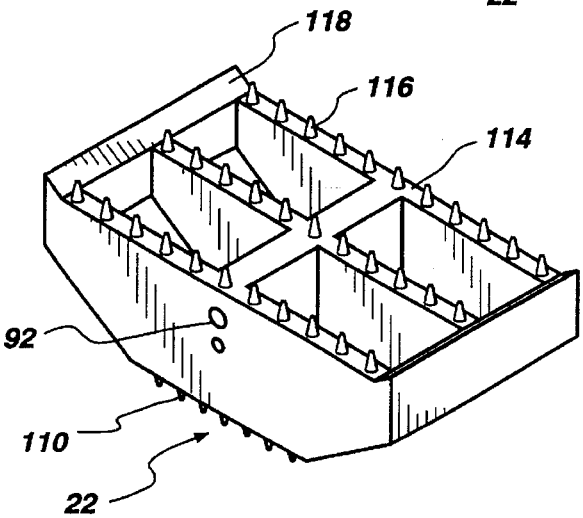
FIG. 7A is a perspective view of one embodiment of the lower side of the base of the kicking pad.
Figure 7B:
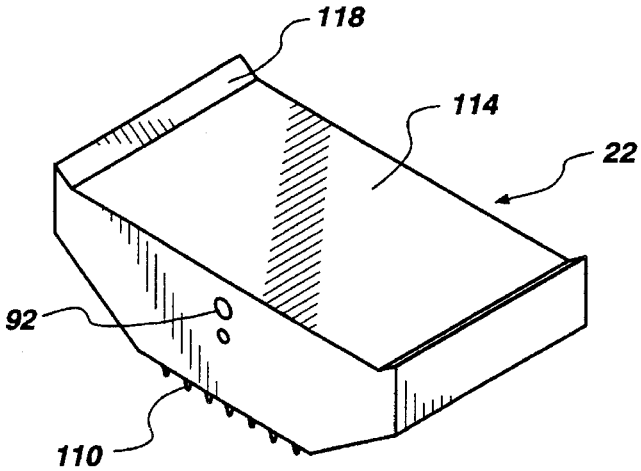
FIG. 7B is a perspective view of an alternate embodiment of the lower side of the base of the kicking pad.

On the lower surface 114 of base 22 are formed spikes 116 for engaging turf such as grass or artificial fibers and materials on a practice field or other supporting surface. The spikes 116 are preferred, and a blade 118 is provided on each end of base 22 to prevent lower surface 114 of base 22 from being supported above the turf and allowing slipping with respect to the supporting surface. Thus, blades 118 assure that base 22 will sink into and engage turf. Base 22 may be a hollow block as shown in FIG. 7A or a solid, molded block as shown in FIG. 7B. Likewise, although the preferred embodiment of base 22 relies on spikes 116 to engage the turf, blades 118 alone may be sufficient for many applications.

Figure 8A:
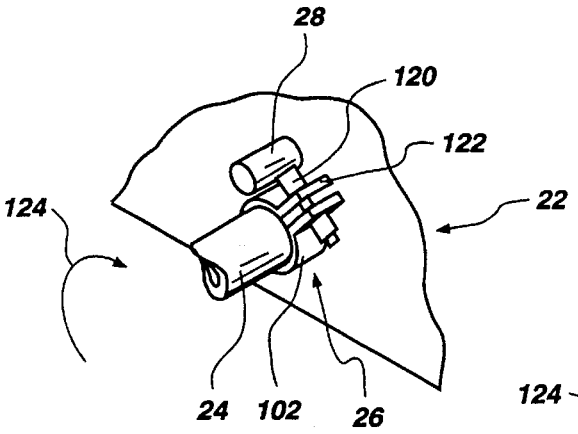
FIG. 8A is a partial perspective view of the preferred embodiment of the adjustment means on the arm of the kicking pad.
Figure 8B:
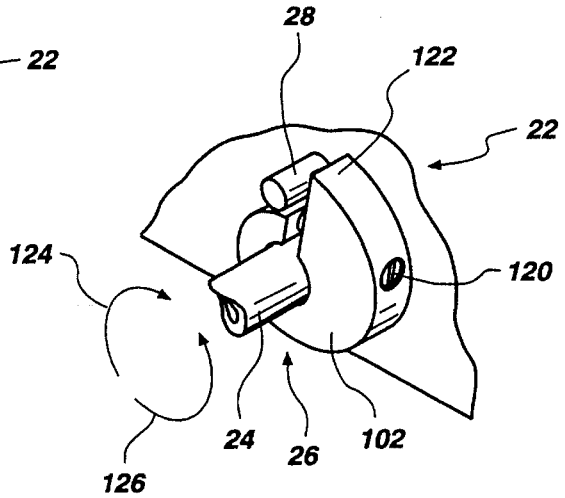
FIG. 8B is a partial perspective view of an alternate embodiment of the adjustment means on the arm of the kicking pad.

Referring to FIGS. 8A and 8B, adjustment means 26 is shown in two embodiments, the embodiment of FIG. 8A being preferred. The clamp 102 is adjusted by screw 120 to adjust friction between clamp 102 and arm 24. Clamp 102 has an ear 122 which engages detent 28, stopping rotation of arm 24. Nevertheless, arm 24 can be rotated within clamp 102 against the frictional force resulting from the force imposed by screw 120.

FIGS. 8A and 8B are shown configured for use with a right foot. The clamp of FIG. 8A can be used with a left foot by merely rotating arm 24 in a clockwise direction 124 until the ear 122 contacts detent 28 from the opposite side. The arm can then be rotated against friction until it is adjusted to the desired position.

The clamp 102 of FIG. 8B must be reversed on arm 24 to rotate freely in a counterclockwise direction 126 for a kicker who uses a left foot. As shown, clamp 102 rotates freely in the clockwise direction 124 for kicking with a right foot.

The tip 100 on arm 24 holds the football at a desired position until kicked. Thereupon, arm 24 freely rotates away from the kicker.

The kicking pad 20 can thus be used with either right or left foot in any of the configurations shown.

Different embodiments of the invention may be made using the principles herein described, but are still within the scope of the invention. These embodiments are illustrative of the invention as practiced in the preferred embodiments, but in no way limit the scope of the invention.

What is claimed is:

1. A goal comprising:

a base for supporting said goal on a surface;

a post having one end thereof pivotally secured to said base;

a substantially U-shaped, member having an open side defining a mouth and an opposite closed side, said U-shaped member being pivotally attached at said closed side thereof to the other end of said post for being selectively positionable between a first position with said open side extending upwardly and above said closed side to form an American football goal, and a second position, wherein said post is inclined upwardly from said base to closed side and said open side extending downwardly from said second end to a location proximate said base, to form a soccer goal.

2. The goal of claim 1, further comprising means for folding said U-shaped member said base and said post to lie substantially on a single surface.

3. The goal of claim 1, wherein said post comprises:

a first section having said one end pivotally attached to said base;

a second section slidable attached to said first section for lengthening and shortening, said second section being a pivotally connecting to said U-shaped member at said other end of said post.

4. The goal of claim 3, wherein said post further comprises means for locking said second section relative to said first section.

5. A goal comprising:

a base for supporting said goal on a surface;

a post having one end pivotally attached to said base;

a york defining a mouth, said yoke being adjustable attached to a second end of said post to be selectively positionable between a first position with said mouth oriented upwardly and a second position with said mouth oriented downwardly, said york comprising a first end and a second end, and said base comprising socket to receive said first and second ends of said yoke.

6. The goal of claim 1, wherein said base, said U-shaped member and said post are tubular structures.

7. The goal of claim 1, further comprising a net attachable to said goal when in said soccer goal form.

8. The goal claim 1 wherein said post is selectively positionable to extend upwardly at an acute angle from said base to said U-shaped member when said U-shaped member is said second position.

9. The goal of claim 1, wherein said U-shaped number has a portion thereof directly attached to said base when said U-shaped member is in said second position.

10. A goal for use in soccer and American football, said goal comprising:

a base for supporting said goal on a surface, said base comprising a lateral arm having a first end and a second end, a first extension connected to said first end and extending substantially perpendicular from said lateral arm along the surface, a second extension connected to said second end and extending substantially perpendicular from said lateral arm along the surface, a post pivotally secured at one end thereof between said first and second ends of said lateral arm to be selectively positionable while remaining connected to said base between a first upright position above said base and a second, inclined, position extending directly between said base and said substantially U-shaped member;

said U-shaped member pivotally connected to said second end of said post, said U-shaped member being selectively positionable as an American football goal and a soccer goal while said U-shaped member, and said base remain continually attached to said post, said U-shaped member having an open end and an opposite closed end, said open being selectively positionable between an upward position extending upwardly above said closed end and a downward position extending from the post in said second pivoted position downwardly below said closed end to a location proximate the surface.

11. The goal of claim 10 wherein said post is comprised of first and second linear sections, said sections being longitudinally slidable for extending said post between a first length and a second length.

12. The goal of claim 11 further comprising locking means for selectively locking said first and second section at a length between said first length and said second length.

13. A goal convertible between an American football goal and a soccer goal, said goal comprising:

a base for supporting said goal on a surface;

a post having one end pivotally attached at one end thereof to said base, said post being pivotable between a first position and a second position relative to said base;

a U-shaped member pivotally attached to the other end of said post, said U-shaped member being selectively positionable between a first position, to form an American football goal with said U-shaped member opening upwardly from said post when pivoted in said first position and a second position, to form a soccer goal with said U-shaped member opening downwardly from said post when pivoted in said second position, said U-shaped member extending substantially vertically downward to a position proximate said base.

14. The goal of claim 13, wherein said post comprises:

a first linear section having a first end pivotally attached to said base;

a second linear section telescopically connected to said first section for selectively extending and retracting said post, said second section having a second end pivotally attached to said U-shaped member.

15. The goal of claim 13 wherein said post extends upwardly at an acute angle from said base when in said second position and when said U-shaped member opens downwardly towards said base.

16. A goal convertible between an American football goal and a soccer goal, said goal comprising:

a base for supporting said goal on a surface;

a post having one end pivotally attached to said base, said post being pivotable between a first post position and a second post position;

a U-shaped member attached the other end of said post to be selectively positionable between a first position opening upwardly and a second position opening downwardly, said U-shaped member comprising a first leg and a second leg spaced from said first leg, and said base further comprising sockets to receive an end of said first and second legs when said U-shaped member is in said second position.

* * * * *